US009039786B2

(12) United States Patent
Jang et al.

(10) Patent No.: US 9,039,786 B2
(45) Date of Patent: May 26, 2015

(54) CONTROL METHOD OF LAUNDRY MACHINE

(75) Inventors: Jae Hyuk Jang, Seoul (KR); Bon Kwon Koo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 157 days.

(21) Appl. No.: 13/392,610

(22) PCT Filed: Aug. 27, 2010

(86) PCT No.: PCT/KR2010/005808

§ 371 (c)(1),
(2), (4) Date: Feb. 27, 2012

(87) PCT Pub. No.: WO2011/025312

PCT Pub. Date: Mar. 3, 2011

(65) Prior Publication Data

US 2012/0151688 A1 Jun. 21, 2012

(30) Foreign Application Priority Data

Aug. 27, 2009 (KR) ..... 10-2009-0079912
Aug. 27, 2009 (KR) ..... 10-2009-0079923
Aug. 27, 2009 (KR) ..... 10-2009-0080122

(51) Int. Cl.
*C11D 3/00* (2006.01)
*D06F 37/22* (2006.01)
*D06F 37/20* (2006.01)

(52) U.S. Cl.
CPC ..... *D06F 37/225* (2013.01); *D06F 37/203* (2013.01)

(58) Field of Classification Search
CPC ... D06F 37/203; D06F 37/225; D06F 37/007; D06F 37/22; D06F 37/269
USPC ..... 68/139, 12.06, 140, 23.1, 24, 12.02, 68/23 R; 8/159, 137, 158; 700/279
See application file for complete search history.

(56) References Cited

U.S. PATENT DOCUMENTS 4,916,768 A 4/1990 Broadbent
7,568,366 B2 * 8/2009 Chang et al. ..... 68/24
2006/0016228 A1 1/2006 Chang et al. ..... 68/23.1

(Continued)

FOREIGN PATENT DOCUMENTS

CN 001240848 A 1/2000
CN 1572954 A 2/2005
CN 1619042 A 5/2005

(Continued)

OTHER PUBLICATIONS

U.S. Office Action dated Mar. 28, 2013 issued in U.S. Appl. No. 13/392,628.

(Continued)

*Primary Examiner* — Michael Barr
*Assistant Examiner* — Thomas Bucci
(74) *Attorney, Agent, or Firm* — Ked & Associates, LLP

(57) ABSTRACT

A control method of a laundry machine is disclosed. The control method of a laundry machine comprising a balancer includes an unbalance sensing step, wherein the unbalance sensing step recognizes an unbalancemaximum value and an unbalanceminimum value of an unbalance wave and the unbalance sensing step determines an average value of the two unbalance maximumvalue and unbalanceminimum value to be of the unbalance generated in a drum provided in the laundry machine.

11 Claims, 10 Drawing Sheets

(56) References Cited

U.S. PATENT DOCUMENTS

| | | | | |
|---|---|---|---|---|
| 2008/0289118 | A1* | 11/2008 | Park et al. | 8/159 |
| 2009/0183318 | A1 | 7/2009 | Kim et al. | 8/159 |

FOREIGN PATENT DOCUMENTS

| | | | |
|---|---|---|---|
| CN | 1724742 | A | 1/2006 |
| CN | 1854377 | A | 11/2006 |
| CN | 101230532 | A | 7/2008 |
| CN | 101311404 | A | 11/2008 |
| CN | 101492874 | A | 7/2009 |
| EP | 1 096 050 | A2 | 5/2001 |
| EP | 1 619 286 | | 1/2006 |
| EP | 2 000 576 | A2 | 4/2008 |
| EP | 1 918 447 | A1 | 5/2008 |
| EP | 1 921 197 | A2 | 5/2008 |
| EP | 1950336 | A1 * | 7/2008 |
| EP | 1 995 366 | | 11/2008 |
| EP | 2 083 109 | | 7/2009 |
| RU | 2 262 563 | C1 | 10/2005 |
| RU | 2 337 193 | C2 | 10/2008 |
| RU | 2 362 847 | C2 | 7/2009 |
| WO | WO 2008/075987 | | 6/2008 |

OTHER PUBLICATIONS

U.S. Office Action dated Apr. 10, 2013 issued in U.S. Appl. No. 13/392,648.

Russian Decision to Grant a Patent dated Apr. 30, 2013 issued in Application No. 2012111654 (with English Translation).

Chinese Office Action dated Jun. 4, 2014 issued in Application No. 201080042947.9 (with English Translation).

Chinese Office Action dated Mar. 4, 2014, issued in Application No. 201080042483.1.

Chinese Office Action dated Mar. 25, 2014, issued in Application No. 201080042203.7.

International Search Report and Written Opinion dated Feb. 24, 2011 issued in Application No. PCT/KR2010/005808.

International Search Report and Written Opinion dated Feb. 25, 2011 issued in Application No. PCT/KR2010/005803.

International Search Report and Written Opinion dated Feb. 25, 2011 issued in Application No. PCT/KR2010/005810.

International Search Report and Written Opinion dated Feb. 25, 2011 issued in Application No. PCT/KR2010/005819.

International Search Report issued in PCT Application No. PCT/KR2010/005808 dated Feb. 24, 2011.

United States Final Office Action issued in U.S. Appl. No. 13/392,648 dated Oct. 29, 2013.

United States Final Office Action issued in U.S. Appl. No. 13/392,628 dated Nov. 5, 2013.

European Search report dated Oct. 30, 2014.

United States Final Office Action issued in U.S. Appl. No. 13/392,648 dated Dec. 26, 2014.

* cited by examiner

CONTROL METHOD OF LAUNDRY MACHINE

TECHNICAL FIELD

The present invention relates to a control method of a laundry machine.

BACKGROUND ART

In general, a laundry machine may include washing, rinsing and spinning cycles. Here, the spinning cycle includes a rotating step of rotating a drum provided in such a laundry machine at the highest RPM. Because of the step, the spinning cycle would generate noise and vibration quite a lot, which is required to be solved in the art the prevent invention pertains to.

DISCLOSURE OF INVENTION

Technical Problem

Accordingly, the present invention is directed to a control method of a laundry machine.

An object of the present invention is to provide a control method of a laundry machine which can solve the above problem.

Solution to Problem

To solve the problems, an object of the present invention is to provide a control method of a laundry machine comprising a balancer, the control method including determining unbalance amount of a drum based on at least one of unbalance_minimum value and unbalance_maximum vale of predetermined time period for an unbalance wave.

Advantageous Effects of Invention

The present invention has following advantageous effects.

According to the control method of the present invention described above, it is possible to calculate the amount of unbalance generated in the laundry machine including the ball balancer.

Furthermore, it is possible to determine based on the amount of unbalance whether the speed of the drum is increased or decreased within a reduced time.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings:

FIG. 1 is a diagram illustrating a configuration of a laundry machine according to a first embodiment, which a spinning cycle control method according to the present invention is applicable to;

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

As follows, an exemplary embodiment of the present invention will be described in reference to the accompanying drawings. First of all, a laundry machine a control method according to an embodiment of the present invention can be applied to will be described and the control method according to an embodiment of the present invention will be described after that.

Figure 1:
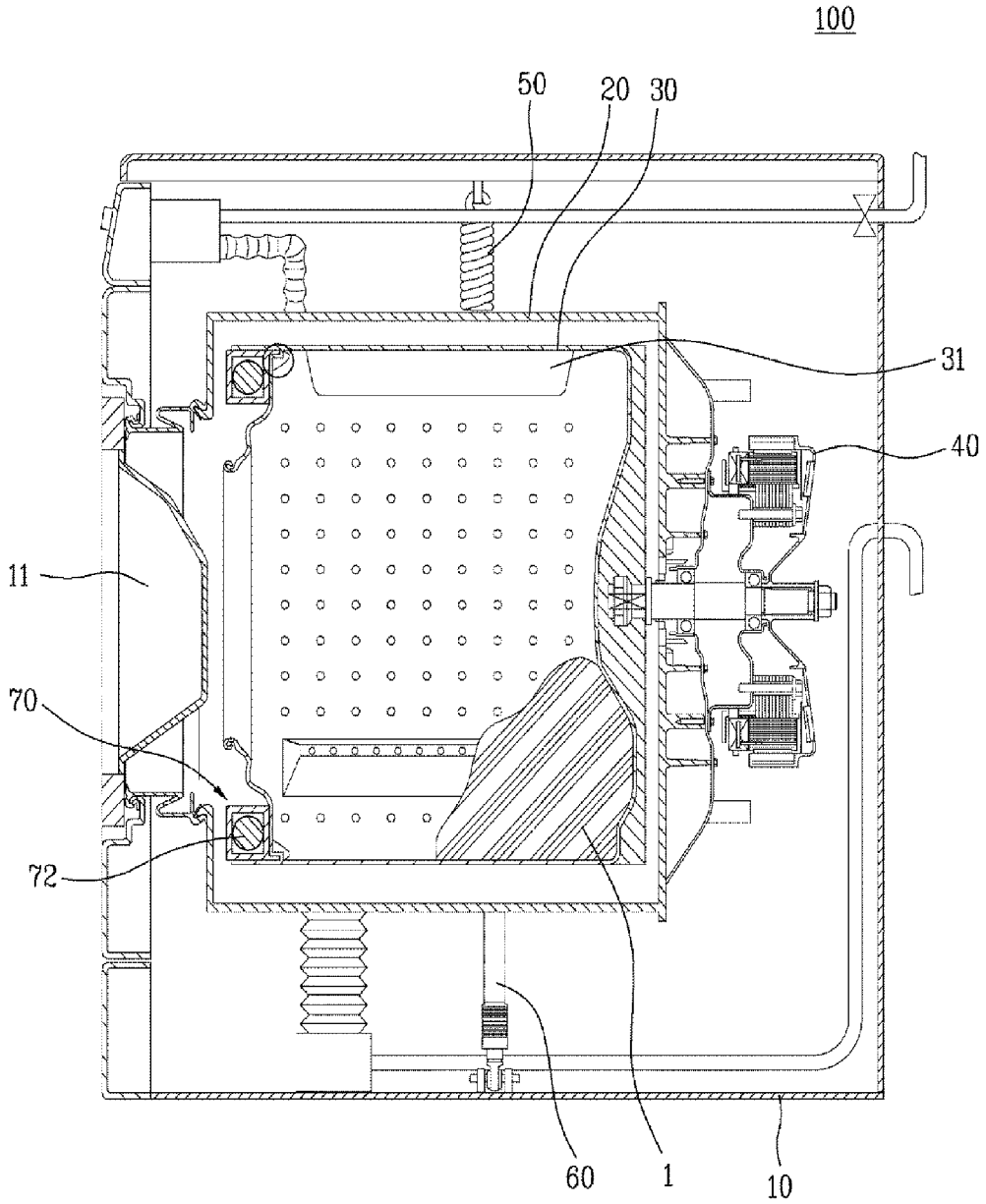

In reference to FIG. 1, a laundry machine 100 includes a cabinet 10 configured to define an exterior appearance thereof, a tub 20 mounted in the cabinet 10 to hold wash water therein and a drum 30 rotatably provided in the tub 20.

The cabinet 10 defines the exterior appearance of the laundry machine 100 and configuration elements which will be described later may be mounted in the cabinet 10. A door 11 is coupled to a front of the cabinet 10 and a user may open the door 11 to load laundry items including clothes, beddings, cloth items and the like (hereinafter, 'laundry' into the cabinet 10.

The tub 20 configured to hold wash water therein may be provided in the cabinet 10 and the drum configured to receive the laundry therein may be rotatale within the tub 20. In this case, a plurality of lifters 31 may be provided in the drum 30 to lift and drop the laundry during the rotation of the drum 30.

The tub 20 may be supported by a spring 50 provided above the tub 20. Here, a motor 40 is mounted to a rear surface of the tub 20 to rotate the drum 30. That is, the motor 40 is provided in a rear wall of the tub 20 and it rotates the drum 30. When vibration is generated in the drum 30 rotated by the motor 40, the tub 20 provided in the laundry machine according to this embodiment may be vibrated in communication with the drum 30. When the drum 30 is rotated, the vibration generated in the drum 30 and the tub 20 may be absorbed by a damper 60 provided below the tub 20.

As shown in FIG. 1, the tub 20 and the drum 30 may be provided in parallel to a base of the cabinet 10 or tilted downward although not shown in the drawing. As the user loads the laundry into the drum 30, it is advantageous that the front portions of the tub 20 and the drum 30 should be tilted upward.

To suppress the vibration of the drum in a spinning cycle that the drum is rotated, specially, at a high speed, a balancer 70 is provided in a front surface and/or rear surface to balance the drum and the balancer 70 will be described in detail later.

According to a laundry machine according to an embodiment, the tub may be fixedly supported to the cabinet or it may be supplied to the cabinet by a flexible supporting structure such as a suspension unit which will be described later. Also, the supporting of the tub may be between the supporting of the suspension unit and the completely fixed supporting.

That is, the tub may be flexibly supported by the suspension unit which will be described later or it may be complete-fixedly supported to be movable more rigidly. Although not shown in the drawings, the cabinet may not be provided unlike embodiments which will be described later. For example, in case of a built-in type laundry machine, a predetermined space in which the built-in type laundry machine will be installed may be formed by a wall structure and the like, instead of the cabinet. In other words, the built-in type laundry machine may not include a cabinet configured to define an exterior appearance thereof independently.

Figure 2:
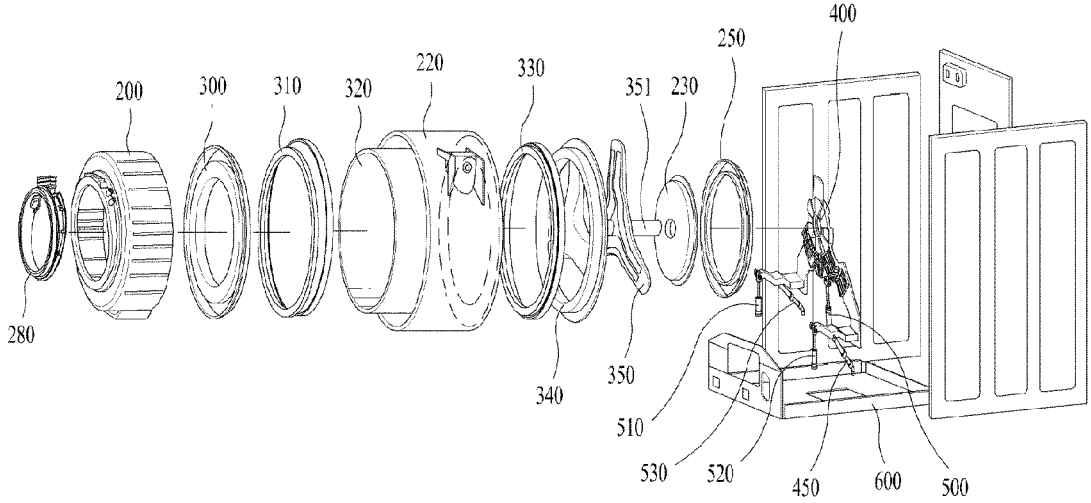
FIG. 2 is an exploded perspective view illustrating a laundry machine according to a second embodiment of the present invention.
Figure 3:
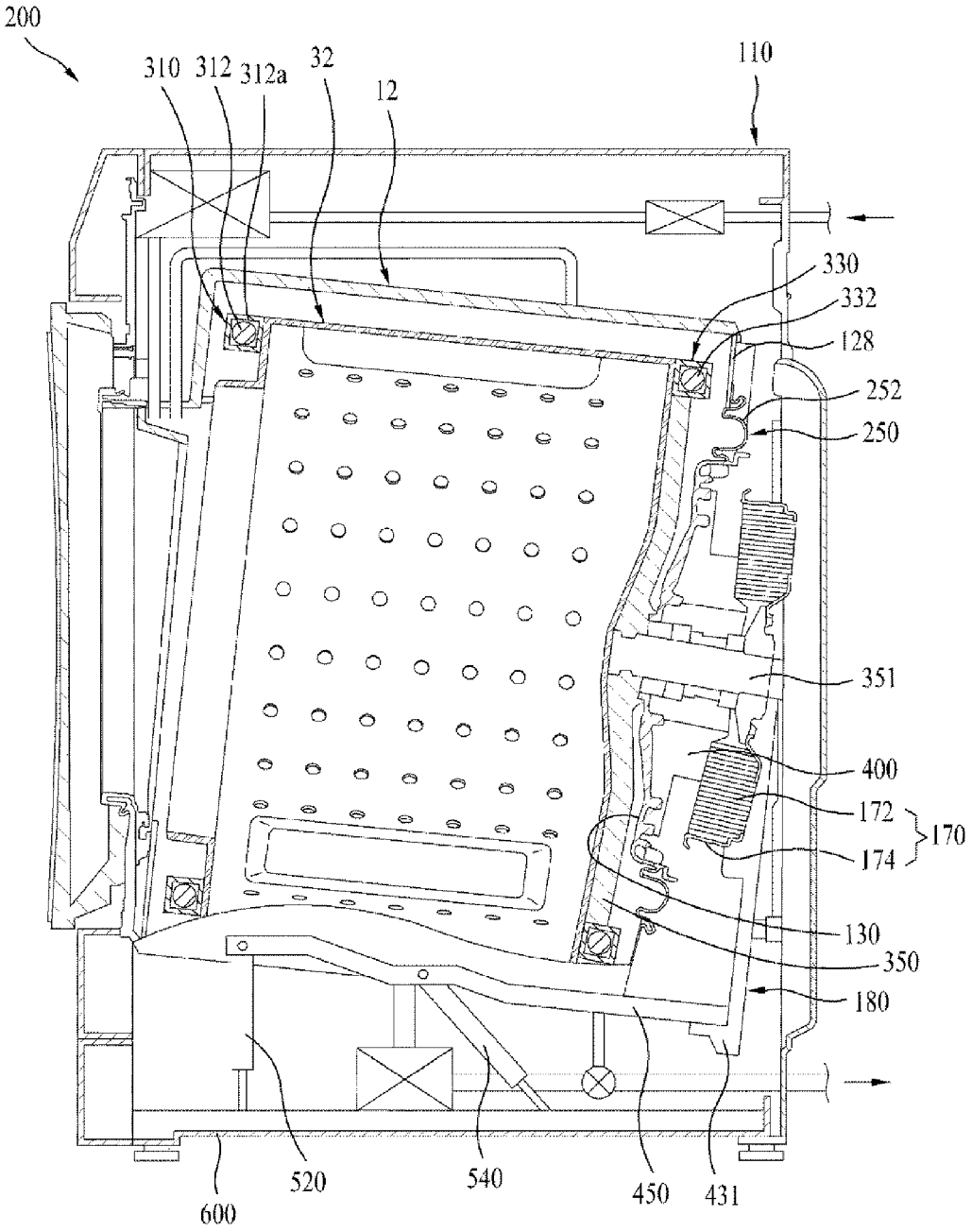
FIG. 3 is a sectional view illustrating a connecting state of the laundry machine shown in FIG. 2.

In reference to FIGS. 2 and 3, a tub 12 provided in the laundry machine is fixedly supported to a cabinet. The tub 12 includes a tub front 100 configured to define a front part of the tub and a tub rear 120 configured to define a rear part of the tub. The tub front 100 and the tub rear 120 are assembled to each other by screws, to form a predetermined space big enough to accommodate the drum. The tub rear 120 has an opening formed in a rear portion thereof and an inner circumference of the rear portion composing the tub rear 120 is connected with an outer circumference of a rear gasket 250. The tub back 130 has a through-hole formed in a center thereof to pass a shaft to pass there through. The rear gasket 250 is made of a flexible material not to transmit the vibration of the tub back 130 to the tub rear 120.

The tub rear 120 has a rear surface 128 and the rear surface 128, the tub back 130 and the rear gasket 250 may define a rear wall of the tub. The rear gasket 250 is connectedly sealed with the tub back 130 and the tub rear 120, such that the wash water held in the tub may not leak. The tub back 130 is vibrated together with the drum during the rotation of the drum. At this time, the tub back 130 is distant from the tub rear 120 enough not to interfere with the tub rear. Since the rear gasket 250 is made of the flexible material, the tub back 130 is allowed to relative-move, without interference of the tub rear 120. The rear gasket 250 may include a corrugated portion 252 extendible to a predetermined length to allow the relative-motion of the tub back 130.

A foreign substance preventing member 200 configured to prevent foreign substances from drawn between the tub and the drum may be connected to a front portion of the tub front 100. The foreign substance preventing member 200 is made of a flexible material and it is fixed to the tub front 100. Here, the foreign substance preventing member 200 may be made of the flexible material identical to the material composing the rear gasket 250. Hereinafter, the foreign substance preventing member 200 will be referenced to as 'front gasket'.

The drum 32 includes a drum front 300, a drum center and a drum back 340. Balancers 310 and 330 may be installed in front and rear parts of the drum, respectively. The drum back 340 is connected with a spider 350 and the spider 350 is connected with the shaft 351. The drum 32 is rotated in the tub 12 by a torque transmitted via the shaft 351.

The shaft 351 is directly connected with a motor 170, passing through the tub back 130. Specifically, a rotor 174 composing the motor 170 is directly connected with the shaft 351. a bearing housing 400 is secured to a rear portion of the tub back 130 and the bearing housing 400 rotatably supports the shaft, located between the motor 170 and the tub back 130.

A stator 172 composing the motor 170 is secured to the bearing housing 400 and the rotor 174 is located surrounding the stator 172. As mentioned above, the rotor 174 is directly connected with the shaft 351. Here, the motor 170 is an outer rotor type motor and it is directly connected with the shaft 351.

The bearing housing 400 is supported via a suspension unit with respect to a cabinet base 600. The suspension unit 180 includes three perpendicular supporters and two oblique supporters configured to support the bearing housing 400 obliquely with respect to a forward and rearward direction.

The suspension unit 180 may includes a first cylinder spring 520, a second cylinder spring 510, a third cylinder spring 500, a first cylinder damper 540 and a second cylinder damper 530.

The first cylinder spring 520 is connected between a first suspension bracket 450 and the cabinet base 600. The second cylinder spring 510 is connected between a suspension bracket 440 and the cabinet base 600.

The third cylinder spring 500 is directly connected between the bearing housing 400 and the cabinet base 600.

The first cylinder damper 540 is inclinedly installed between the first suspension bracket 450 and a rear portion of the cabinet base. The second cylinder damper 530 is inclinedly installed between the second suspension bracket 440 and a rear portion of the cabinet base 600.

The cylinder springs 520, 510 and 500 of the suspension unit 180 may be elastically connected to the cabinet base 600 enough to allow a forward/rearward and rightward/leftward movement of the drum, not connected to the cabinet base 600 fixedly. That is, they are elastically supported by the base 600 to allow the drum to be rotated to a predetermined angle in forward/rearward and rightward/leftward directions with respect to the connected portion.

The perpendicular ones of the suspension unit may be configured to suspend the vibration of the drum elastically and the oblique ones may be configured to dampen the vibration. That is, in a vibration system including a spring and damping means, the perpendicular ones are employed as spring and the oblique ones are employed as damping means.

The tub front 100 and the tub rear 120 are fixedly secured to the cabinet 110 and the vibration of the drum 32 is suspendedly supported by the suspension unit 180. The supporting structure of the tub 12 and the drum 32 may be called 'separated' substantially, such that the tub 12 may not be vibrated even when the drum 32 is vibrated.

The bearing housing 400 and the suspension brackets may be connected with each other by first and second weights 431 and 430.

In case the drum 30 and 32 is rotated after the laundry 1 is loaded in the drum 30 and 32 of the laundry machine according to the above embodiments, quite severe noise and vibration may be generated according to the position of the laundry 1. For example, when the drum 30 and 32 is rotated in a state of the laundry not distributed in the drum 30 and 32 uniformly (hereinafter, 'unbalanced rotation'), much noise and vibration may be generated. Especially, if the drum 30 and 32 is rotated at a high speed to spin the laundry, the noise and vibration may be problematic.

Because of that, the laundry machine may include balancer to prevent the noise and vibration generated by the unbalanced rotation of the drum 30 and 32. The balancer may be provided in a front or rear portion, or in both of the portions of the drum 30 and 32.

The balancers are mounted to the drum 30 and 32 to reduce the unbalance. Because of that, the balancer may have a movable gravity center. For example, the balancer may include movable bodies having a predetermined weight located therein and a passage the movable bodies move along.

If the balancers may be ball balancers, the balancer 70, 310 and 330 may include balls 72, 312 and 332 having a predetermined weight located therein and a passage the ball moves along.

More specifically, the balls are rotated by the friction generated during the rotation of the drum 30 and 32 and they are not kept unmovable in the drum when the drum is rotated. Because of that, the balls are rotated at a different speed from the rotation speed of the drum. Here, the laundry which generates the unbalance may be rotated at the almost same speed as the speed of the drum because of the friction generated by the close contact with an inner circumferential surface of the drum and the lifters provided in the inner circumferential surface. As a result, the rotation speed of the laundry is different from that of the balls. The rotation speed of the laundry is higher than that of the balls during an initial rotation stage in which the drum is rotated at a relatively low speed, specifically, a rotation angle speed of the laundry is higher. In addition, a phase difference between the balls and the laundry, which is a phase difference with respect to a rotation center of the drum, may changes continuously.

Hence, when the rotation speed of the drum is getting higher, the balls may be in close contact with an outer circumferential surface of the passage by the centrifugal force. At the same time, the balls are aligned at a predetermined position having approximately 90° to 180° of the phase difference with respect to the laundry. If the rotation speed of the drum is a predetermined value or more, the centrifugal force is getting larger and the friction generated between the outer circumferential surface and the balls is a predetermined value or more and the balls may be rotated at the same speed as the drum. at this time, the balls are rotated at the same speed as the drum, with maintaining the position having the 90° to 180°, preferably, approximately 180° of the phase difference with respect to the laundry. In this specification of the present invention, the rotation of the balls at the predetermined positions as mentioned above may be expressed as 'unbalance corresponding position' or 'balancing'.

As a result, in case load is concentrated on a predetermined portion of the drum inside by the laundry, the ball located in the balancer 70, 310 and 330 may move to an unbalance corresponding position to reduce the unbalance.

As follows, a control method of the laundry machine having the above configuration according to the above embodiments will be described. typically, the laundry machine includes washing, rinsing and spinning cycles and the control method according to the present invention which is be applicable to the spinning cycle will be described in reference to corresponding drawings.

Figure 4:
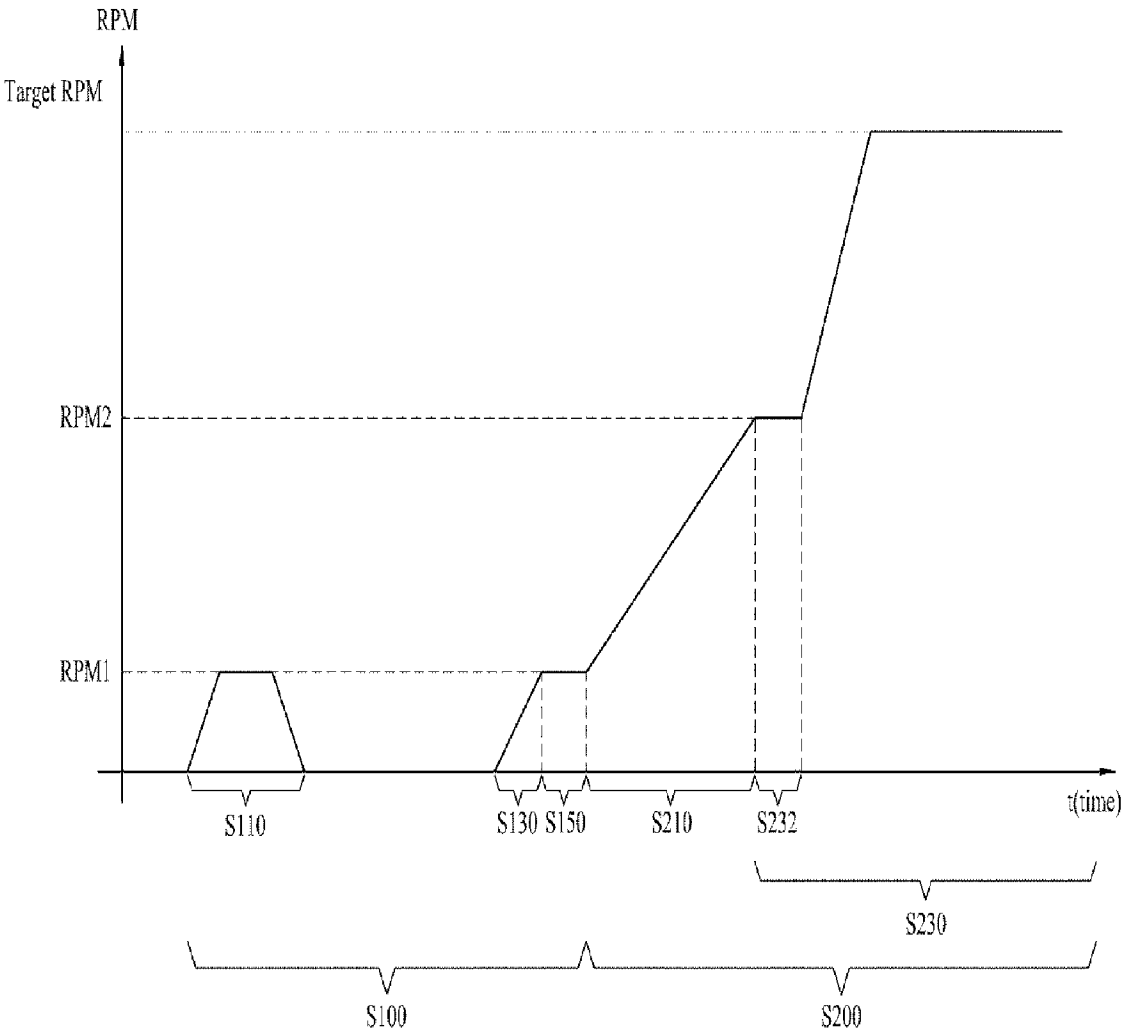
FIG. 4 is a graph illustrating change of a rotation speed of a drum according to the spinning cycle control method of the present invention.

FIG. 4 is a graph illustrating RPM change of the drum as the time passes according to the control method of the spinning cycle. According to FIG. 4, a horizontal axis is 'time' and a vertical axis is 'rotation speed' of the drum 30 and 32 which is change of RPM.

In reference to FIG. 4, the spinning cycle control method according to the present invention includes a laundry distributing step (S100) and a spinning step (S200).

The laundry distributing step (S100) distributes the laundry uniformly, as rotating the drum at a relatively low speed. The spinning cycle (S200) rotates the drum at a relatively high speed to remove moisture contained in the laundry. Here, such the laundry distributing step and spinning step are named with respect to main functions thereof. The functions of the steps may not be limited to the names. For example, the laundry distributing step may remove the moisture of the laundry by using the rotation of the drum, as well as the laundry distributing.

The laundry distributing step (S100) composing the control method according to the present invention may include a wet laundry sensing step (S110), a laundry disentangling step (S130) and an unbalance sensing step (S150). The spinning step (S200) may include a transient region passing step (S210) and an accelerating step (S230). As follows, each one of the above steps will be described.

Once the rinsing cycle is completed, the laundry located in the drum 30 and 32 is wet by the moisture. A control part senses the amount of the laundry, that is, the amount of the wet laundry located in the drum 30 and 32, when the spinning cycle is put into operation (S110).

The reason why the amount of the wet laundry is that the amount of the dry laundry measured in an initial stage of the washing cycle is different from the amount of the wet laundry containing the moisture. The sensed amount of the wet laundry may be used as an element configured to determine an allowable condition of the drum accelerating or to determine to re-implement the laundry distributing step after decreasing the speed of the drum 30 and 32 based on an unbalance condition in the transient region passing step (S210).

According to the control method of the present invention, the amount of the wet laundry located in the drum 30 and 32 is measured in case the drum is rotated at a decreased speed after rotated at a constant speed of approximately 100 to 110 RPM reached by the acceleration for a predetermined time period. If the rotation speed of the drum is decreased, rheostatic braking is used. Specifically, the amount of the wet laundry is measured by using the amount of acceleration period rotation in accelerating the motor 40 and 170 configured to rotate the drum 30 and 32, the amount of the acceleration period rotation in decreasing the speed of the motor 40 and 170, and an applied DC voltage.

After measuring the amount of the wet laundry, the control part may implement the laundry disentangling step (S130) configured to distribute the laundry inside the drum uniformly.

The laundry disentangling step distributes the laundry located in the drum 30 and 32 uniformly to prevent the laundry from concentrated on a specific region inside the drum, which might increase the unbalance. If the unbalance is increased, noise and vibration will be increased in case the RPM of the drum is heightened. The laundry disentangling step accelerates the drum in a predetermined single direction with a predetermined oblique and it is implemented until the RPM reaches a rotation speed of the unbalance sensing step which will be described later.

Hence, the control part senses the unbalance of the drum (S150).

If the laundry is concentrated on a specific region inside the drum 30 and 32, not distributed uniformly, the unbalance is increased and the nose and vibration will be generated when the RPM of the drum 30 and 32 is heightened. Because of that, the control part senses the unbalance of the drum and it determines whether the drum is accelerated.

The unbalance sensing uses difference of the accelerated speeds during the rotation of the drum 30 and 32. That is, there is difference of the accelerated speeds when the drum is rotated downward along the gravity and when it is rotated upward reversely according to the level of the generated unbalance. The control part measures the difference of the accelerated speeds by using a speed sensor, for example, a hall sensor provided in the motor 40 and 170 to sense the amount of the unbalance. In case the unbalance is sensed, the laundry located inside the drum keeps the close contact with the inner circumferential surface of the drum, without dropped from the inner circumferential surface, even during the rotation of the drum. The case having the drum rotated at approximately 100 to 110 RPM is corresponding to this case.

In the meanwhile, when the drum is rotated, the laundry machine according to the above embodiments may adapt the balancer to reduce the noise and vibration generated by the unbalance of the laundry located inside the drum. However, the balls of the balancer may be the unbalance applied to the drum, together with the laundry. Especially, the balls are moved along the rotation of the drum. because of that, when the unbalance is sensed by the laundry machine adapting the balancer, there may be an unbalance curvature looking like a sine wave with a predetermined period. As a result, in case the amount of the unbalance changes periodically like the sine wave, the unbalance amount of the drum cannot be determined by the unbalance amount at a predetermined single point simply. As follows, the control method of prevent invention invented to solve that problem will be described.

Figure 5:
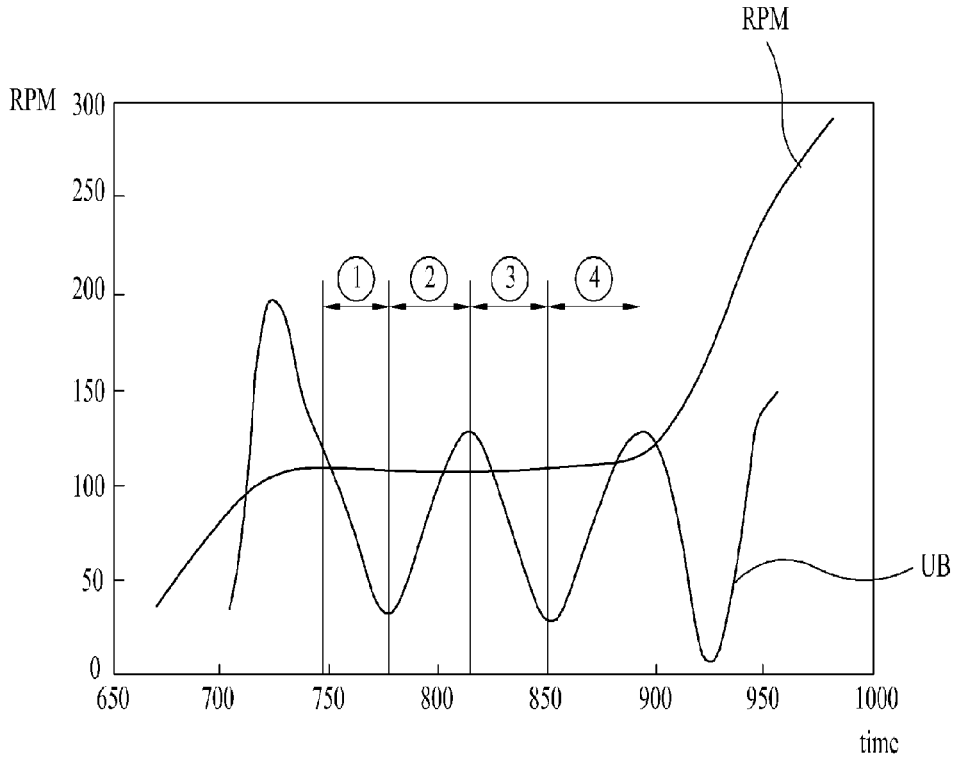
FIG. 5 is a graph illustrating change of an unbalance wave.

FIG. 5 is a graph illustrating change of the unbalance amount sensed when the drum is rotated in the laundry machine adapting the balancer. A horizontal axis is 'time' and a vertical axis is 'unbalance amount' and 'RPM of the drum'. As follows, a control method of the laundry machine for determining the unbalance amount of the drum based on at least one of 'unbalance_minimum value' and 'unbalance_maximum vale' of the predetermined time period for the unbalance curvature like the sine wave having the unbalance being changed periodically will be described.

In reference to FIG. 5, the control part determines whether the unbalance wave increases or decreases, in a predetermined time after the rotation of the drum is maintained to be a first rotation speed, which is approximately 100 to 110 RPM, specifically, in 1 period of FIG. 5. When the unbalance is sensed right after the drum is accelerated to be a predetermined RPM, the unbalance wave is not stabilized only to generate an error.

The control part senses the increasing or decreasing of the unbalance wave in the first period (1 Period) and it senses when the unbalance is the minimum value and the maximum value in the unbalance wave. After that, the control part memorizes 'unbalance_minimum value' and 'unbalance_maximum vale'. That is, when the unbalance wave is increasing, the control part recognizes an unbalance_maximum value and an unbalance_minimum value sequentially. When the unbalance wave is decreasing, the control part recognizes an unbalance_minimum value and an unbalance_ maximum value sequentially.

In reference to an unbalance wave shown in FIG. 5, for example, the unbalance wave of '1 period' decreases and the control part sequentially stores values evaluated when the unbalance is the minimum value and the maximum value in '2 period' and '3 period' as unbalance_minimum value and unbalance_maximum value. Hence, the control part stores an average value of the two unbalance_minimum value and the unbalance_maximum value as the unbalance amount of the drum. That is, in case the drum is rotated at the constant RPM, the control part calculates the unbalance_maximum value and the unbalance_minimum value of the unbalance wave and it recognizes an average value of the two values as unbalance amount of the drum. Because of that, even in case the unbalance amount is changed along the unbalance wave, the amount of the unbalance can be determined accurately.

The control part may calculate the period of the unbalance wave from the time when the unbalance_maximum/minimum values are sensed. In addition, the control part may determine the speed acceleration point of the time based on the period calculated from the time when the unbalance_minimum value is sensed in '3 period'.

In reference to FIG. 4 again, the amount of the wet laundry sensed in the wet laundry sensing step (S110) and the amount of the unbalance sensed in the unbalance sensing step (S150) may be used as elements to determine whether the speed of the drum 30 and 32 is accelerated to pass a transient region.

Specifically, if the drum is accelerated at a high speed in case the sensed unbalance amount of the drum having a predetermined amount of wet laundry is a reference unbalance value or more, the vibration and noise of the drum will increase remarkably and it is difficult to accelerate the speed of the drum. Because of that, the control part may store a reference unbalance value, which allows the acceleration of the speed according to the amount of the wet laundry as a table typed data. After that, the control part applies the sensed wet-laundry amount and the unbalance amount to the table and it determines whether the speed of the drum is accelerated. That is, in case the unbalance amount sensed according to the sensed wet-laundry amount is the reference unbalance value or more, it can be determined that the unbalance amount is too much to accelerate the drum speed and the above wet-laundry sensing, laundry disentangling and unbalance sensing steps are repeated.

As mentioned above, the repetition of the wet laundry sensing step, the laundry disentangling step and the unbalance sensing step may be continued until the sensed unbalance amount meets less than the reference unbalance value. However, if the laundry machine is in an abnormal state or the laundry is entangled severely inside the drum, the sensed unbalance amount cannot meet less tan the reference unbalance value and the steps may be repeated. As a result, it is preferable that the control part controls the drum to stop the rotation and notifies the user that the spinning cycle is not completed normally, if the speed of the drum fails to be accelerated for a predetermined time period, for example, approximately more than 20 to 30 minutes after the spinning cycle starts.

However, according to the method of sensing the unbalance amount based on the average value described above, the unbalance sensing step has to sense both of the unbalance_minimum value and the unbalance_maximum value. Because of that, it takes much time to wait until the unbalance_minimum value and the unbalance_maximum value are calculated from the unbalance wave when the unbalance amount is sensed. As follows, a method of reducing the time taken when the unbalance amount is sensed will be described.

Figure 6:
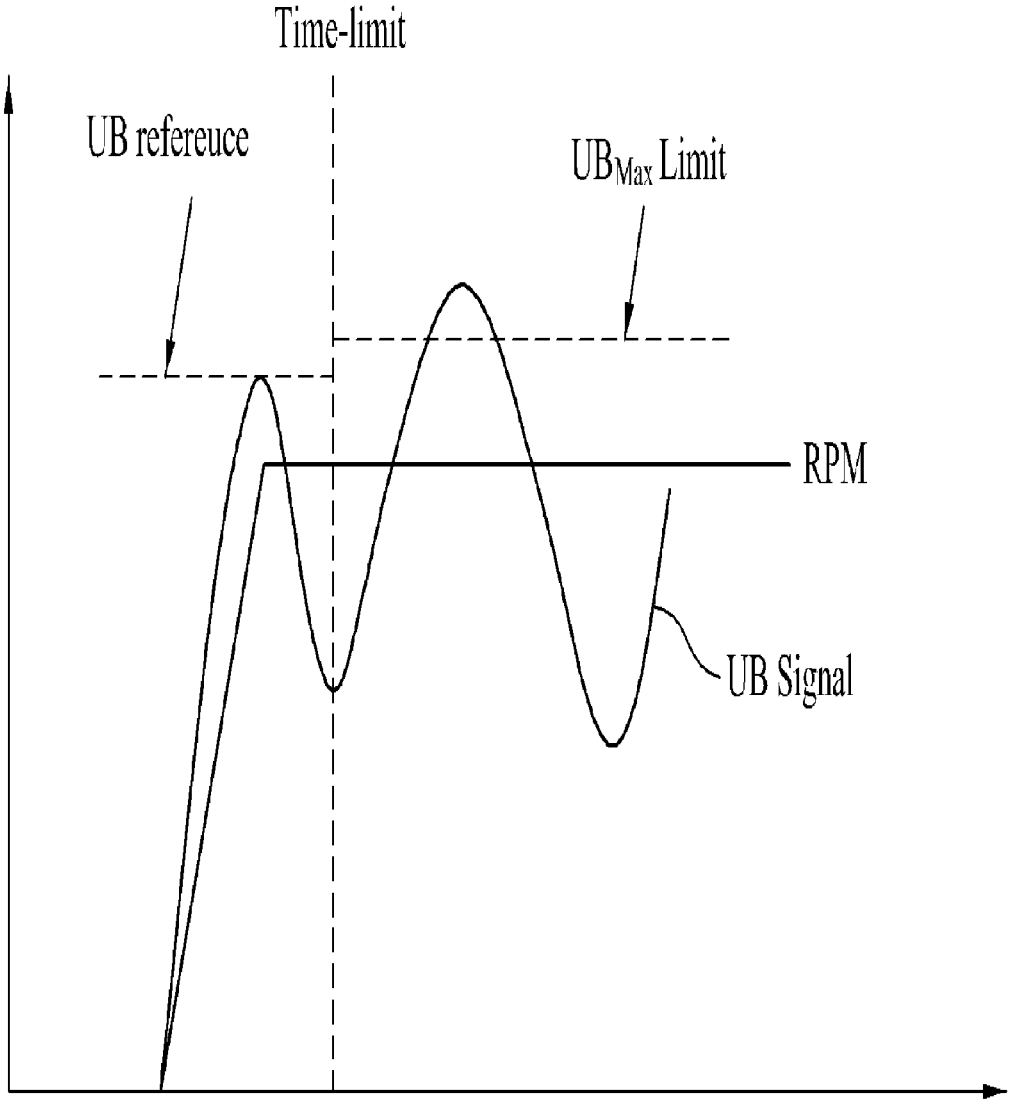
FIGS. 6 and 7 are graphs illustrating changes of different unbalance waves.
Figure 7:
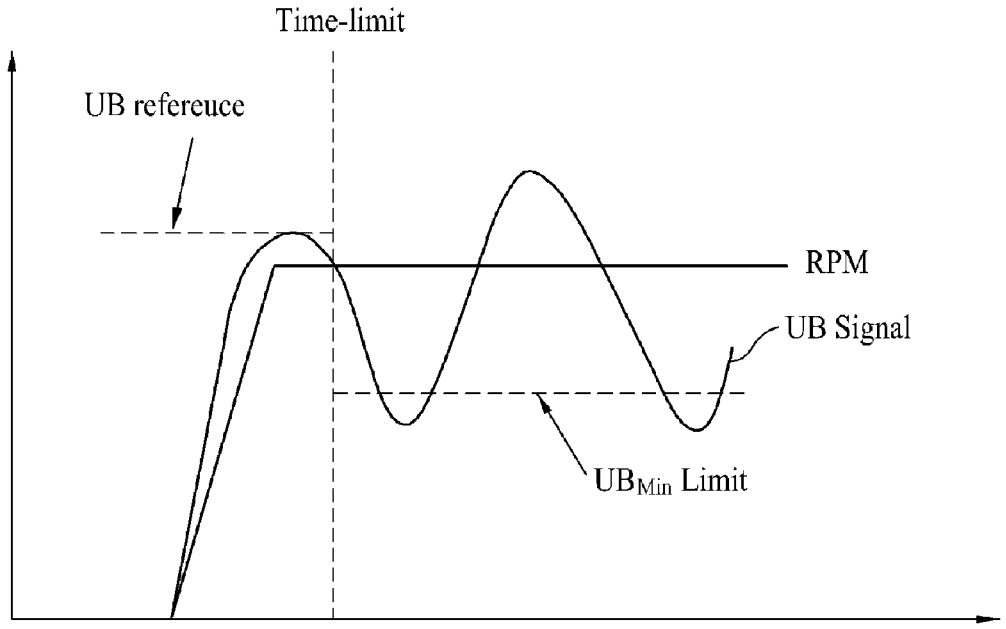

FIGS. 6 and 7 are graphs illustrating unbalance waves having different patterns, respectively.

In reference to FIG. 6, the control part determines whether a first maximum value is a preset 'unbalance_reference (UB_reference)' or more. Here, the first maximum value may be the maximum value generated within a preset time_limit, as the constant rotation speed reaches a first RPM (RPM 1). The unbalance_reference is a value used to determine that the unbalance of the unbalance wave is so large to allow the unbalance sensing step to finish, when the first maximum value is the unbalance_reference or more. As a result, if the first maximum value is the unbalance_reference or more, the unbalance sensing step is completed, without reading the unbalance_maximum value and the unbalance_minimum value from the unbalance wave, and the wet laundry sensing step, the laundry disentangling step and the unbalance sensing step may be repeated.

If the first maximum value is less than the unbalance_reference, the control part may read a value of the next unbalance wave after a predetermined time_limit. If an unbalance value of the unbalance wave within the preset time_limit, the unbalance wave is not stabilized and it is difficult to rear the accurate unbalance value.

Hence, when the unbalance wave increases after the preset time_limit as shown in FIG. 6, the control part determines whether the unbalance wave reaches 'an unbalance_maximum limit (UB_max limit)'.

For example, the unbalance_maximum limit may be preset to be approximately twice as much as the reference unbalance allowing the drum speed to be accelerated. As a result, if the unbalance value reaches the unbalance maximum limit in the increase of the unbalance wave, the average value is the reference unbalance value or more, even even with '0' of the unbalance_maximum limit. If the unbalance reaches the unbalance_maximum limit in the increase of the unbalance wave after the preset time_limit, the control part may not read the unbalance value of the unbalance wave any more only to finish the unbalance sensing step and it re-implements the laundry disentangling step and the unbalance sensing step. Here, the unbalance minimum value of the unbalance is substantially '0' or more and it is preferable that the unbalance_maximum limit is preset to be substantially lower than the value twice as much as the reference unbalance amount.

In case of the unbalance_maximum value which is less than the unbalance_maximum limit (UB max Limit) as the unbalance wave increases after the preset time_limit, the control part reads the unbalance_minimum value and it compares the average value of the two with the reference unbalance amount.

FIG. 7 is a graph illustrating the unbalance wave having the different pattern from that of FIG. 6.

In reference to FIG. 7, the control part determines whether a first maximum value calculated from the unbalance wave is the unbalance_reference or more. The process of reading the value of the unbalance wave after the preset time_limit is identical to that of FIG. 6 and repeated description will be omitted accordingly.

If the unbalance wave decreases after the preset time_limit, the control part determines whether the unbalance wave reaches an unbalance_minimum limit (UB min Limit). Here, the unbalance-minimum limit may be set appropriately.

Figure 8:
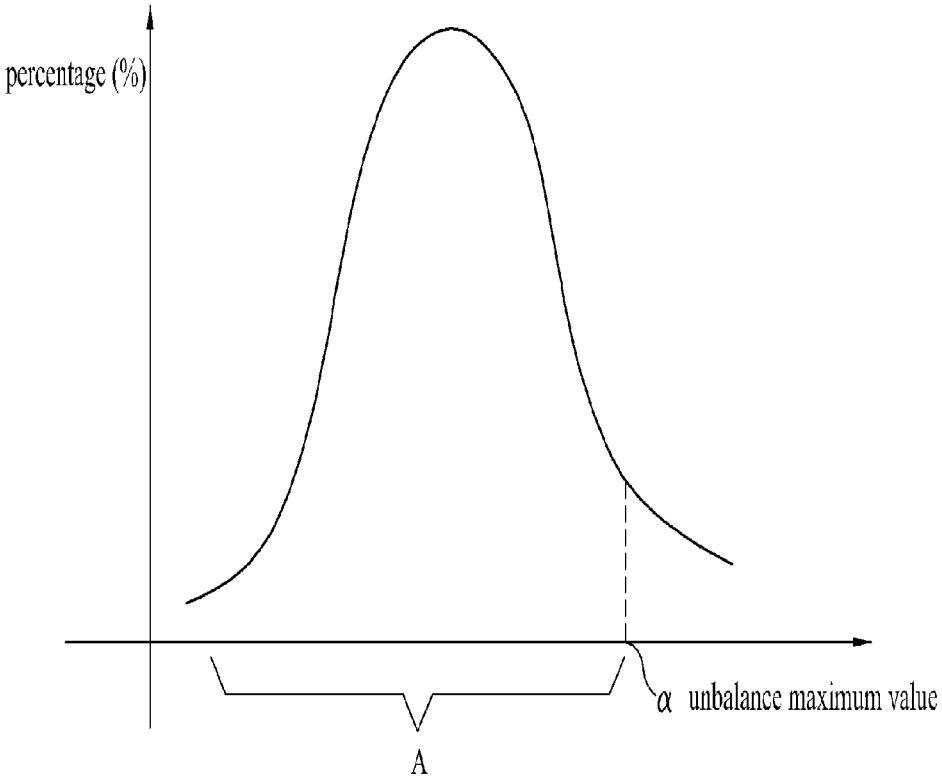
FIG. 8 is a graph illustrating distribution of unbalance_maximum value.

For example, distribution of the unbalance_maximum values through repeated unbalance sensing experiments. FIG. 8 is a graph illustrating the distribution of the unbalance maximum values. A horizontal axis shown in the graph of FIG. 8 is the unbalance maximum value and a vertical axis is a percentage (%) of the corresponding unbalance-maximum. As shown in the graph of FIG. 8, the largest unbalance_maximum value ($\alpha$) may be found in a band having 50% to 90% of the unbalance_maximum. An unbalance_minimum value used to calculate an average value with the unbalance maximum value, which is corresponding to the reference unbalance amount, may be calculated based on the largest unbalance_maximum value ($\alpha$) and the unbalance_minimum value may be set to be the unbalance_minimum limit.

As a result, if the unbalance value reaches the unbalance_minimum limit in the decrease of the unbalance wave after the preset time_limit, the control parts determines that the unbalance is the reference unbalance amount, without reading the unbalance_maximum value, and it implements the next step. If the unbalance wave decreases after the preset time_limit for the unbalance_minimum value to be the unbalance-minimum limit (UB min Limit) or more, the control part reads the unbalance_maximum value and it compares the average value of the maximum and minimum values with the reference unbalance amount.

In reference to FIG. 4 again, in case the unbalance amount sensed according to the sensed wet laundry amount is less than the reference unbalance amount, the RPM accelerating condition is satisfied and the control part implements the transient region passing step (S210).

Here, the transient region is a predetermined RPM band including at least one resonance frequency which generates resonance according to the system of the laundry machine. When the system of the laundry machine is determined, the transient region is a unique vibration property generated according to the determined system. The transient region is variable according to the system of the laundry machine. For example, the transient region includes a scope of approximately 200 to 270 RPM in the laundry according to the first embodiment and a scope of approximately 200 to 350 RPM in the laundry machine according to the second embodiment.

Figure 9:
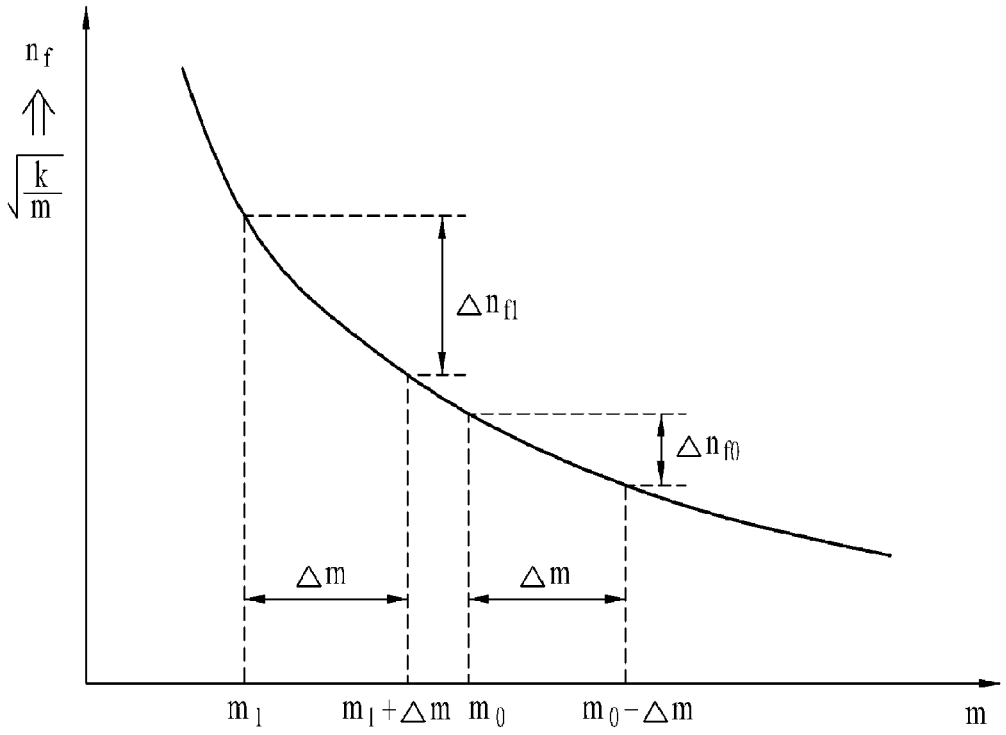
FIG. 9 is a graph showing a relation of mass vs. a natural frequency.

FIG. 9 illustrates a graph showing a relation of mass vs. a natural frequency. It is assumed that, in vibration systems of two laundry machines, the two laundry machines have mass of m0 and m1 respectively and maximum holding laundry amounts are $\Delta m$, respectively. Then, the transition regions of the two laundry machines can be determined taking $\Delta nf0$ and $\Delta nf1$ into account, respectively. In this instance, amounts of water contained in the laundry will not be taken into account, for the time being.

In the meantime, referring to FIG. 9, the laundry machine with smaller mass m1 has a range of the transition region greater than the laundry machine with greater mass m0. That is, the range of the transition region having variation of the laundry amount taken into account becomes the greater as the mass of the vibration system becomes the smaller.

The ranges of the transition regions will be reviewed on the related art laundry machine and the laundry machine of the embodiment.

The related art laundry machine has a structure in which vibration is transmitted from the drum to the tub as it is, causing the tub to vibrate. Therefore, in taking the vibration of the related art laundry machine into account, the tub is indispensible. However, in general, the tub has, not only a weight of its own, but also substantial weights at a front, a rear or a circumferential surface thereof for balancing. Accordingly, the related art laundry machine has great mass of the vibration system.

Opposite to this, in the laundry machine of the embodiment, since the tub, not only has no weight, but also is separated from the drum in view of a supporting structure, the tub may not be put into account in consideration of the vibration of the drum. Therefore, the laundry machine of the embodiment may have relatively small mass of the vibration system.

Then, referring to FIG. 9, the related art laundry machine has mass m0 and the laundry machine of the embodiment has mass m1, leading the laundry machine of the embodiment to have a greater transition region, at the end.

Moreover, if the amounts of water contained in the laundry are taken into account simply, $\Delta m$ in FIG. 9 will become greater, making a range difference of the transition regions even greater. And, since, in the related art laundry machine, the water drops into the tub from the drum even if the water escapes from the laundry as the drum rotates, an amount of water mass reduction come from the spinning is small. Since the laundry machine of the embodiment has the tub and the drum separated from each other in view of vibration, the water escaped from the drum influences the vibration of the drum, instantly. That is, the influence of a mass change of the water in the laundry is greater in the laundry machine of the embodiment than the related art laundry machine.

Under above reason, though the related art laundry machine has the transition region of about 200~270 rpm, A start RPM of the transient region of the laundry machine according to this embodiment may be similar to a start RPM of the transient region of the conventional laundry machine. An end RPM of the transient region of the laundry machine according to this embodiment may increase more than a RPM calculated by adding a value of approximately 30% of the start RPM to the start RPM. For example, the transient region finishes at an RPM calculated by adding a value of approximately 80% of the start RPM to the start RPM. According to this embodiment, the transient region may include a RPM band of approximately 200 to 350 rpm.

In the meantime, by reducing intensity of the vibration of the drum, unbalance may be reduced. For this, even laundry spreading is performed for spreading the laundry in the drum as far as possible before the rotation speed of the drum enters into the transition region.

In a case, a balancer is used, a method may be put into account, in which the rotation speed of the drum passes through the transition region while movable bodies provided in the balancer are positioned on an opposite side of an unbalance of the laundry. In this instance, it is preferable that the movable bodies are positioned at exact opposite of the unbalance in middle of the transition region.

However, as described above, the transient region of the laundry machine according to this embodiment is relatively wide in comparison to that of the conventional laundry machine. Because of that, even if the laundry even-spreading step or ball balancing is implemented in a RPM band lower than the transient region, the laundry might be in disorder or balancing might be failed with the drum speed passing the transient region.

As a result, balancing may be implemented at least one time in the laundry machine according to this embodiment before and while the drum speed passing the transient region. Here, the balancing may be defined as rotation of the drum at a constant-speed for a predetermined time period. Such the balancing allows the movable body of the balancer to the opposite positions of the laundry, only to reduce the unbalance amount. By extension, the effect of the laundry even-spreading. Eventually, the balancing is implemented while the drum speed passing the transient region and the noise and vibration generated by the expansion of the transient region may be prevented.

Here, when the balancing is implemented before the drum speed passing the transient region, the balancing may be implemented in a different RPM band from the RPM of the conventional laundry machine. For example, if the transient region starts at 200 RPM, the balancing is implemented in the RPM band lower than approximately 150 RPM. Since the conventional laundry machine has a relatively less wide transient region, it is not so difficult for the drum speed to pass the transient region even with the balancing implemented at the RPM lower than approximately 150 RPM. However, the laundry machine according to this embodiment has the relatively wide expanded transient region as described above. if the balancing is implemented at the such the low RPM like in the conventional laundry machine, the positions of the movable bodies might be in disorder by the balancing implemented with the drum speed passing the transient region. Because of that, the laundry machine according to this embodiment may increase the balancing RPM in comparison to the conventional balancing RPM, when the balancing is implemented before the drum speed enters the transient region. That is, if the start RPM of the transient region is determined, the balancing is implemented in a RPM band higher than a RPM calculated by subtracting a value of approximately 25% of the start RPM from the start RPM. For example, the start RPM of the transient region is approximately 200 RPM, the balancing may be implemented in a RPM band higher than 150 RPm lower than 200 RPM.

Moreover, the unbalance amount may be measured during the balancing. That is, the control method may further include a step to measure the unbalance amount during the balancing and to compare the measured unbalance amount with an allowable unbalance amount allowing the acceleration of the drum speed. If the measured unbalance amount is less than the allowable unbalance amount, the drum speed is accelerated after the balancing to be out of the transient region. In contrast, if the measured unbalance amount is the allowable unbalance amount or more, the laundry even-spreading step may be re-implemented. in this case, the allowable unbalance amount may be different from an allowable unbalance amount allowing the initial accelerating.

That is, in case the rotation speed of the drum 30 and 32 passes the transient region, the resonance is generated in the laundry machine and noise and vibration of the laundry machine are generated remarkably. The noise and vibration of the laundry machine will give an unpleasant feeling to the user and they will interfere with the acceleration of the drum speed. As a result, in case the rotation speed of the drum passes the transient region, an acceleration inclination may be adjusted appropriately in the transient region and to noise and vibration may be maintained as little as possible during the acceleration of the drum 30 and 32.

In the meanwhile, as the drum 30 and 32 is accelerated while the speed passing the transient region, the unbalance amount of the drum 30 and 32 may be increased by an unexpected shock applied from the outside. If the unbalance amount of the drum 30 and 32 is a predetermined value or more, the noise will be increased noticeably and it is difficult to accelerate the drum continuously. Because of that, while the speed passing the transient region, the control part may sense the unbalance amount of the drum 30 and 32 continuously.

In addition, a vibration sensor is provided in the drum of the laundry machine to allow the control part to sense the vibration of the drum in the transient region. Especially, the tub provided in the laundry machine having the vibration of the tub separated from that of the drum is fixedly installed and only the drum is vibrated. Because of that, it is necessary for the control part to sense the unbalance amount of the drum 30 and 32 continuously while the speed passing the transient region, to prevent contact between the drum and the tub. The sensed vibration and/or unbalance amount of the drum 30 and 32 in the transient region passing step is a predetermined value or more, the control part decreases the speed of the drum 30 and 32 and it repeats the wet laundry sensing step, the laundry disentangling step and the unbalance sensing step described above.

The control part implements the balancing step (232) after the speed passing the transient region.

As mentioned above, the laundry machine the control method according to the present invention is applied to may include the balancer 310 and 330 to prevent the noise and vibration generated by the unbalance. The balls provided in the balancer 310 and 330 move to the unbalance corresponding positions to reduce the unbalance. The balls may move more smoothly while the drum is rotated at the accelerated speed than at the constant speed and they may move more smoothly at the high speed than at the low speed. Because of that, in case the drum is rotated at the relatively high speed, the balls cannot move to the unbalance corresponding positions properly. As a result, the control method according to the present invention may include a balancing step configured to enable the balls to move to the unbalance corresponding positions after the speed passing the transient region.

In this case, the RPM required to implement the balancing may be set to be higher than the transient region of the laundry machine. The balancing is more advantageous to implement as the RPM is lower. If the RPM of the drum 30 and 32 is decreased to be lower than the transient region again to implement the balancing, noise and vibration generated by resonance would occur. Because of that, it is preferable that the balancing is implemented at the RPM higher than the transient region. For example, the balancing of the control method according to the present invention may be implemented at a second rotation speed, that is, 350 to 400 RPM.

As mentioned above, after implementing the balancing at least one time, the control part controls the RPM of the drum 30 and 32 to increase to a target RPM to remove the moisture. In this case, the control part controls the constant speed rotation of the drum at the target RPM for a predetermined time period, such that the moisture may be removed from the laundry smoothly.

Figure 10:
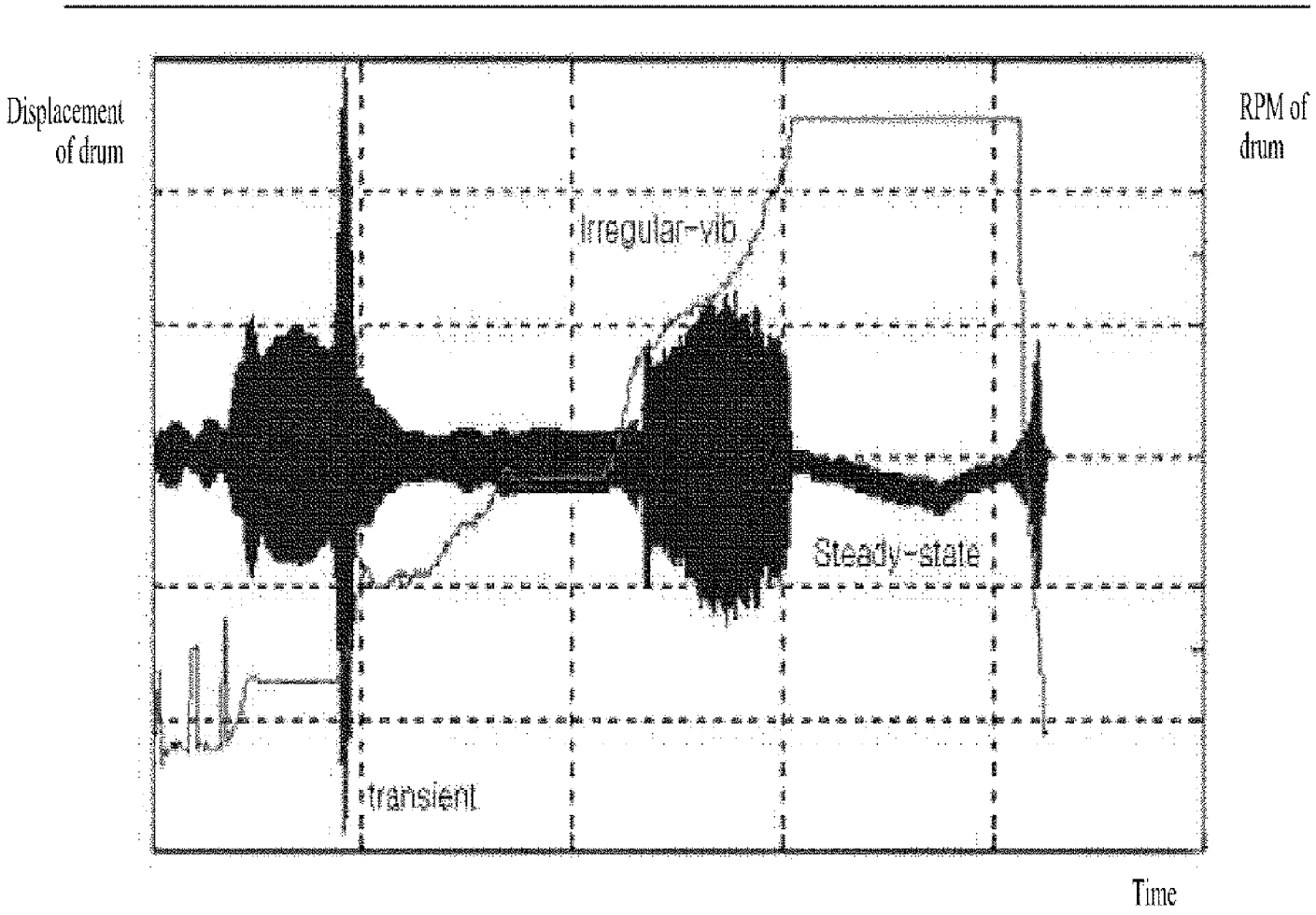
FIG. 10 is a graph illustrating vibration characteristics of the laundry machine of FIG. 3.

First, vibration characteristics of the laundry machine according to the embodiment of the present invention will now be described with reference to FIG. 10.

As the rotation speed of the drum is increased, a region (hereinafter, referred to as "transient vibration region") where irregular transient vibration with high amplitude occurs is generated. The transient vibration region irregularly occurs with high amplitude before vibration is transited to a steady-state vibration region (hereinafter, referred to as "steady-state region"), and has vibration characteristics determined if a vibration system (laundry machine) is designed. Though the transient vibration region is different according to the type of the laundry machine, transient vibration occurs approximately in the range of 200 rpm to 270 rpm. It is regarded that transient vibration is caused by resonance. Accordingly, it is necessary to design the balancer by considering effective balancing at the transient vibration region.

In the mean time, as described above, in the laundry machine according to the embodiment of the present invention, the vibration source, i.e., the motor and the drum connected with the motor are connected with the tub 12 through the rear gasket 250. Accordingly, vibration occurring in the drum is little forwarded to the tub, and the drum is supported by a damping means and the suspension unit 180 via a bearing housing 400. As a result, the tub 12 can directly be fixed to a cabinet 110 without any damping means.

As a result of studies of the inventor of the present invention, vibration characteristics not observed generally have been found in the laundry machine according to the present invention. According to the general laundry machine, vibration (displacement) becomes steady after passing through the transient vibration region. However, in the laundry machine according to the embodiment of the present invention, a region (hereinafter, referred to as "irregular vibration") where vibration becomes steady after passing through the transient vibration region and again becomes great may be generated. For example, if the maximum drum displacement or more generated in an RPM band lower than the transient region or the maximum drum displacement or more of steady state step in a RPM band higher than the transient region is generated, it is determined that irregular vibration is generated. Alternatively, if an average drum displacement in the transient region, +20% to −20% of the average drum displacement in the transient region or ⅓ or more of the maximum drum displacement in the natural frequency of the transient region are generated, it may be determined that the irregular vibration is generated.

However, as a result of the studies, irregular vibration has occurred in a RPM band higher than the transient region, for example has occurred at a region (hereinafter, referred to as "irregular vibration region") in the range of 350 rpm to 1000 rpm, approximately. Irregular vibration may be generated due to use of the balancer, the damping system, and the rear gasket. Accordingly, in this laundry machine, it is necessary to design the balancer by considering the irregular vibration region as well as the transient vibration region.

For example, the balancer is provide with a ball balancer, it is preferable that the structure of the balancer, i.e., the size of the ball, the number of balls, a shape of the race, viscosity of oil, and a filling level of oil are selected by considering the irregular vibration region as well as the transient vibration region. When considering the transient vibration region and/or the irregular vibration region, especially considering the irregular vibration region, the ball balancer has a greater diameter of 255.8 mm and a smaller diameter of 249.2. A space of the race, in which the ball is contained, has a sectional area of 411.93 $mm^2$. The number of balls is 14 at the front and the rear, respectively, and the ball has a size of 19.05 mm. Silicon based oil such as Poly Dimethylsiloxane (PDMS) is used as the oil. Preferably, oil has viscosity of 300 CS at a room temperature, and has a filling level of 350 cc.

In addition to the structure of the balancer, in view of control, it is preferable that the irregular vibration region as well as the transient vibration region is considered. For example, to prevent the irregular vibration, if the irregular vibration region is determined, the balancing may be implemented at least one time before, while and after the drum speed passes the irregular vibration region. Here, if the rotation speed of the drum is relatively high, the balancing of the balancer may not be implemented properly and the balancing may be implemented with decreasing the rotation speed of the drum. however, if the rotation speed of the drum is decreased to be lower than the transient region to implement the balancing, it has to pass the transient region again. In decreasing the rotation speed of the drum to implement the balancing, the decreased rotation speed may be higher than the transient region.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The present invention has an industrial applicability.

According to the control method of the present invention described above, it is possible to calculate the amount of unbalance generated in the laundry machine including the ball balancer.

Furthermore, it is possible to determine based on the amount of unbalance whether the speed of the drum is increased or decreased within a reduced time.

The invention claimed is:

1. A control method for a laundry machine comprising a balancer, the control method comprising:

determining an unbalance amount of a drum based on at least one of an unbalance minimum value and an unbalance maximum value of predetermined time period for an unbalance wave, wherein the determining further comprises: recognizing an unbalance maximum value and an unbalance minimum value of the unbalance wave after a predetermined time limit rotating the drum at a predetermined constant RPM; and determining an average value of the unbalance maximum value and unbalance minimum value to he the unbalance amount of the drum.

2. The control method as claimed in claim 1, wherein the unbalance maximum value and the unbalance minimum value are recognized sequentially when the unbalance wave is increasing and the unbalance minimum value and the unbalance maximum value are recognized when the unbalance wave is decreasing.

3. The control method as claimed in claim 1, wherein the unbalance sensing step is completed, in case a maximum value calculated from the unbalance wave before the predetermined time limit is a predetermined reference value or more, and a laundry disentangling step and the unbalance sensing step are implemented.

4. The control method as claimed in claim 1, wherein an unbalance sensing step is completed based on a preset unbalance limit value after the predetermined time limit, and a laundry disentangling step and the unbalance sensing step are implemented or a spinning step is implemented.

5. The control method as claimed in claim 4, wherein the unbalance sensing step is complemented if the unbalance wave reaches an unbalance maximum limit value while increasing, and the laundry disentangling step and the unbalance sensing step are implemented.

6. The control method as claimed in claim 4, wherein the unbalance sensing step is complemented if the unbalance wave reaches an unbalance minimum limit while decreasing, and the spinning step is implemented.

7. The control method as claimed in claim 1, wherein a period of the unbalance wave is recognized by a time difference between the unbalance maximum value and the unbalance minimum value.

8. The control method as claimed in claim 7, wherein an accelerating point of the drum speed is determined based on the period.

9. The control method as claimed in claim 1, wherein the laundry machine comprises a driving unit comprising a shaft connected to a drum, a bearing housing to rotatably support the shaft, and a motor to rotate the shaft, and a suspension assembly is connected to the driving unit.

10. The control method as claimed in claim 1, wherein the laundry machine comprises a rear gasket for sealing to prevent washing water from leaking from a space between a driving unit and a tub, and enabling the driving unit movable relative to the tub.

11. The control method as claimed in claim 1, wherein a tub is supported rigidly more than a drum being supported by a suspension assembly.

* * * * *